US005680800A

United States Patent [19]

Sharpe

[11] Patent Number: 5,680,800

[45] Date of Patent: Oct. 28, 1997

[54] SOCKET DRIVE EXTENSION GRIP

[76] Inventor: Jon B. Sharpe, 5218 Pleasant Ridge Rd., Knoxville, Knox County, Tenn. 37912

[21] Appl. No.: 558,076

[22] Filed: Nov. 13, 1995

[51] Int. Cl.[6] ..... B25B 23/16

[52] U.S. Cl. ..... 81/177.2; 81/437

[58] Field of Search ..... 81/177.1, 177.2, 81/437

[56] References Cited

U.S. PATENT DOCUMENTS 1,161,270 11/1915 Vance .
4,350,064 9/1982 Markle ..... 81/177.2 X
5,005,448 4/1991 Main ..... 81/63
5,299,475 4/1994 Stroop ..... 81/489

FOREIGN PATENT DOCUMENTS 1147176 5/1983 Canada ..... 81/177.2

*Primary Examiner*—James G. Smith
*Attorney, Agent, or Firm*—Pitts & Brittian, P.C.

[57] ABSTRACT

A socket drive extension grip for securing to a socket drive extension to provide greater flexibility to the use of a socket tool. The socket drive extension includes a handle, a shaft tube secured within the handle and for receiving the shaft of a socket drive extension and a clamping device for securely holding the socket drive extension within the handle and shaft tube and preventing the shaft from rotating.

8 Claims, 2 Drawing Sheets

SOCKET DRIVE EXTENSION GRIP

TECHNICAL FIELD

This invention relates to the field of tool apparatus and more specifically, to a hand grip sleeve for a socket tool.

BACKGROUND ART

Socket wrenches are utilized to screw in bolts in a more efficient manner than using a traditional wrench. As with any tool, a socket wrench has its limitations. The rachet driver associated with the socket wrench is not useable in limited spaces. Further, when taking up bolt slack, using the rachet driver is highly inefficient.

Several hand grips have been produced which are used with tools. Typical of the art are those devices disclosed in the following U.S. Patents:

| U.S. Pat. No. | Inventor(s) | Issue Date |
|---|---|---|
| 1,161,270 | W. A. Vance | Nov. 23, 1915 |
| 5,005,448 | H. M. Main | April 9, 1991 |
| 5,299,475 | J. A. Stroop | April 5, 1994 |

The '270 patent teaches an auxiliary handle for tools which is secured upon a handle of an existing handle of a tool. The handle is intended to absorb any shocks or jars incident to the use of the tool. Also, the handle provides a firmer grip.

The '448 patent teaches a speed wrench and a hand grip combination. The speed wrench is a new tool and the hand grip is configured to receive the outer surface of the speed wrench.

The '475 patent teaches a tool and adjustable handgrip wherein a tool includes a first and second handle sleeve which are removable to provide for handgrips of various thicknesses. The handgrip is not intended to provide an alternative method for using a particular tool.

Therefore, it is an object of the present invention to provide a socket drive extension grip for use with a socket drive extension to provide greater flexibility in the socket's use.

It is another object of the present invention to provide a socket drive extension grip which when secured to a socket drive extension provides sufficient torque.

It is yet another object of the present invention to provide a socket drive extension grip which is configured to receive either end of a socket drive extension such that the grip can be utilized in combination with a rachet driver.

SUMMARY

Other objects and advantages will be accomplished by the present invention which provides a socket drive extension grip for securing to a socket drive extension. The socket drive extension grip defines a shaft tube secured within a handle and a clamping device for securing the handle and shaft tube to the shaft of the socket drive extension and preventing the socket drive extension from rotating in the shaft tube.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

Figure 1:
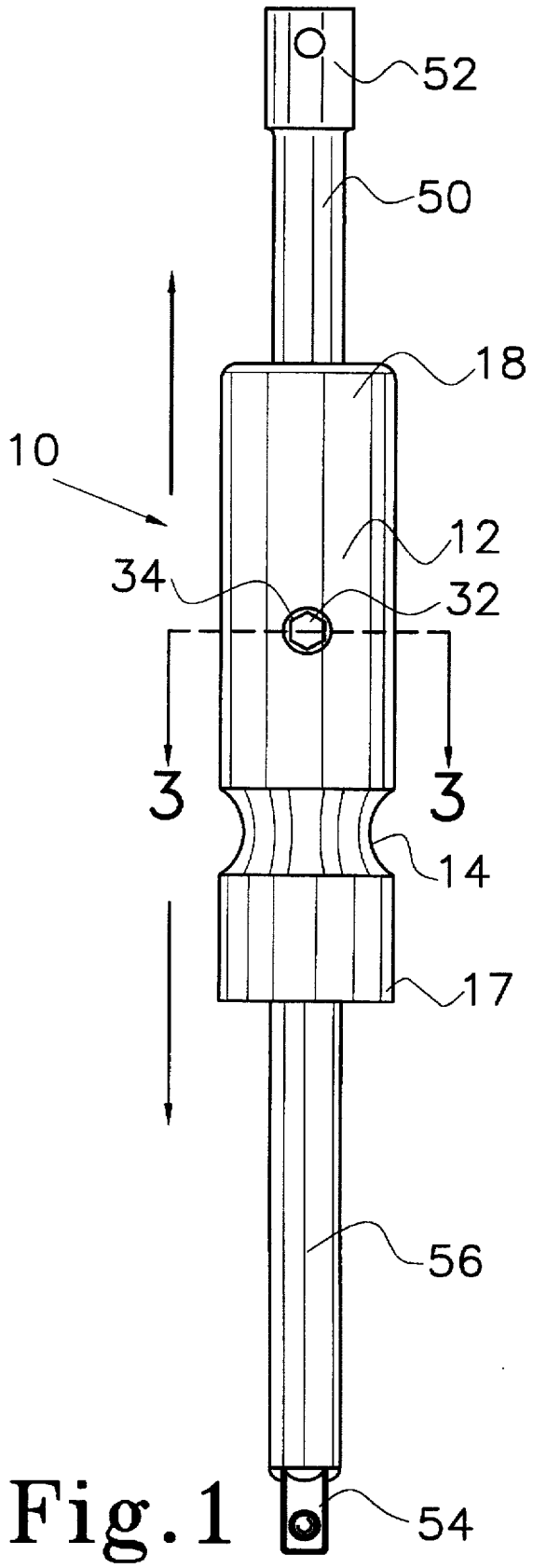
FIG. 1 is a side view of the socket drive extension grip received by a socket drive extension construction in accordance with several features of the present invention.
Figure 3:
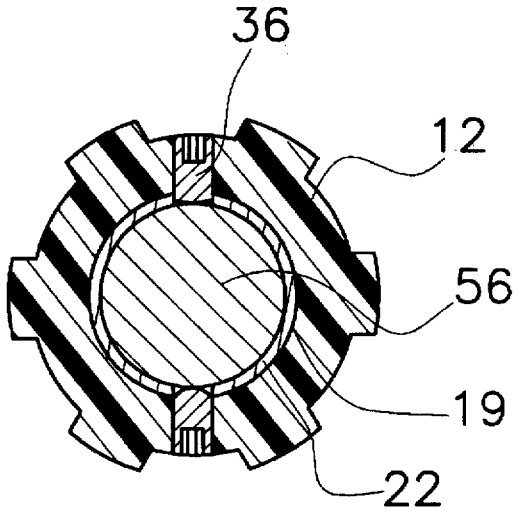
FIG. 3 is a cross sectional view of the socket drive extension grip taken at 3—3 of FIG. 1.
Figure 2:
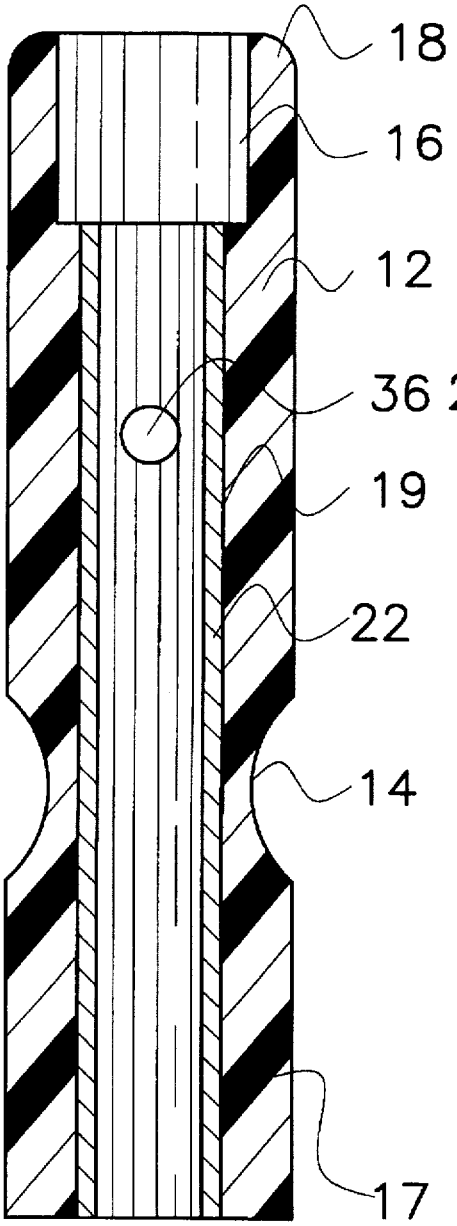
FIG. 2 illustrates a cross sectional view of the socket drive extension grip of FIG. 1.

A socket drive extension grip incorporating various features of the present invention is illustrated generally at 10 in the figures. The socket drive extension grip 10 is designed to be used in conjunction with a socket drive extension 50 to provide greater flexibility in the socket tool's use. Moreover, in the preferred embodiment, the socket drive extension grip 10 is designed to be secured to the socket drive extension 50 in a manner such that sufficient torque can be imparted to the drive extension 50.

The socket drive extension grip 10 is generally comprised of a handle 12, a shaft tube 22 and a clamping device 32, as shown in FIGS. 1–4. The handle 12 is configured to be easily gripped. The shaft tube 22 is mounted within the handle 12 and is configured to closely receive a socket drive extension 50, as shown in the Figures. The clamping device 32 serves to secure the handle 12 to the socket drive extension 50 when the handle 12 is positioned in the desired location along the socket drive extension 50.

The handle 12 is configured to be easily and comfortably gripped by a user. In the preferred embodiment, the handle 12 is fabricated from plastic and preferably is formed through an injection mold process. In one embodiment, the corners are rounded and the outside diameter is 1.125 inches. The handle defines a first end 17, a second end 18, and an opening 19 extending between the first and second ends 17, 18 for receiving the shaft tube 22, shown clearly in FIG. 2. The handle 12 defines a recessed area 14 approximately one half inch from the first end 17 to provide an anchor point for the index finger of the user. In the preferred embodiment, the handle 12 is 4½ inches in length and hexagonal in shape.

It is preferable that a socket drive extension grip 10 is produced in 3 sizes to fit a ¼ inch drive extension 50, a ⅜ inch drive extension 50, and a ½ inch drive extension 50. For a ¼ inch and ⅜ inch socket drive extension 50, the handle 12 defines a countersunk area 16 for the head 52 of the socket drive extension 50. The diameter of the countersunk area 16 is determined by the size of the socket drive extension 50: for a ¼ inch drive the diameter is 0.500 inches and for a ⅜ inch drive the diameter is 0.750 inches. The upper end of a ½ inch socket drive extension grip has a chamfered area (not shown) for the neck of the drive extension such that the head of the extension protrudes above the handle.

The shaft tube 22 is joined to the handle 12, preferably during the injection molding process. In the preferred embodiment, the shaft tube 22 is fabricated from a suitable rigid material such as cold rolled steel or the like. The shaft tube 22 is 3 inches in length and manufactured from 0.100 inch thick sheet material. The shaft tube 22 has slots pressed into its outside diameter to provide gripping points for the handle 12 during the molding process. The inner diameter of the shaft tube 22 is determined by the socket drive extension 50, the inner diameter is 0.325 inches for a ¼ inch drive; 0.500 inches for a ⅜ inch drive; and 0.750 inches for a ½ inch drive.

The clamping device 32 serves to lock the handle 12 in position. A first embodiment of the clamping device 32 is shown most clearly in FIG. 3. A set of threaded openings 36 is defined by the handle 12 and shaft 22. The openings 36 are set 180 degrees apart. Each of the openings 36 is configured to receive a set screw 34. In one embodiment, the set screws 34 are ¼–24 carbon steel Grade 5 allen head set screws. Preferably, the set screws 34 are ⅜ inches long. When the set screws 34 are tightened against the drive extension shaft 56, the resulting friction prevents the shaft 56 from spinning with respect to the handle 12 for all torques below 40 foot-pounds.

In an alternate embodiment, the handle 12 and the shaft tube 22 define one threaded opening 36 for receiving a set screw 34. When the set screw 34 is inserted, the shaft 56 of the socket drive extension 50 is wedged within the shaft tube 22.

Figure 4:
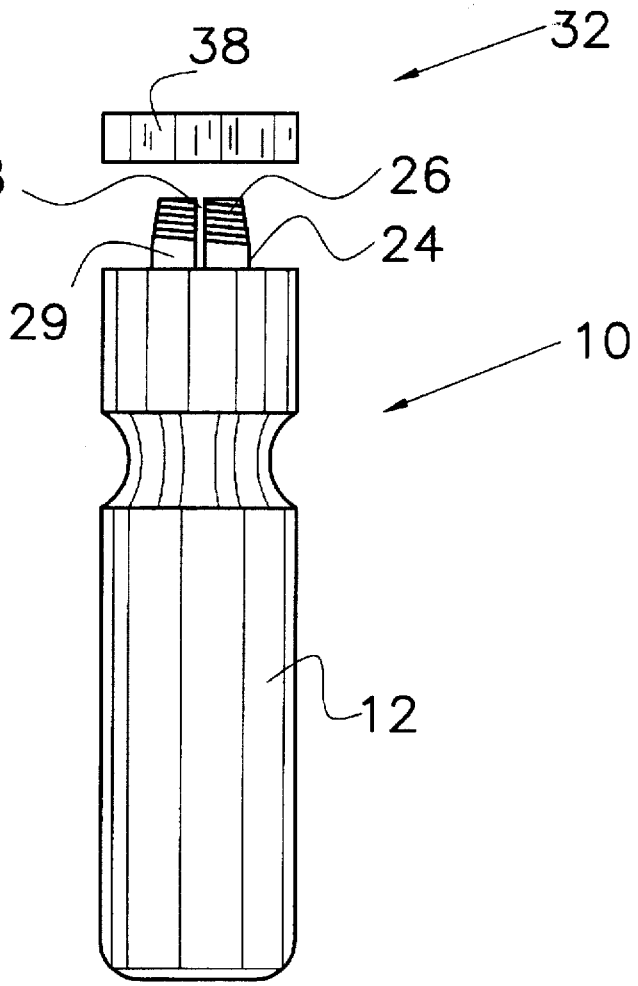
FIG. 4 illustrates a side view of the socket drive extension grip illustrating an alternate clamping device.

A second embodiment of the clamping device 32 is illustrated in FIG. 4. The shaft tube 22 defines an extended portion 24 into which a tapered thread 26 is cut. The extended portion 24 defines at least two slots extending in the direction of the axis to form at least two tube sections 29. In the preferred embodiment, the shaft tube 22 defines four slots 28 thereby forming four tube sections 29, as shown in FIG. 4. Preferably, the slots 28 are of sufficient length to allow adequate clamping for a range of shaft diameters and 90 degrees apart. The tapered thread 26 receives a clamp nut 38. As the clamp nut 38 is tightened on the tapered thread 26, the tube sections 29 created by the slots 28 in the shaft tube 22 are forced against the socket drive extension shaft 50, with the resulting friction preventing the shaft 50 from spinning with respect to the handle 12. In the preferred embodiment, the clamp nut 38 is fabricated from carbon steel Grade 5. Preferably, it is hexagonal in shape.

The socket drive extension grip 10 is utilized by sliding the grip 10 over the socket drive extension 50 and then tightening the clamp device 32. The socket drive extension grip 10 can be utilized in one of three ways. In a first use, a rachet driver is used as before with the socket drive extension grip 10 in place. In a second use, the socket drive extension grip 10 is used as a screwdriver-type driver for screwing in bolts. Finally, in a third use, the socket drive extension grip 10 is used in conjunction with a rachet driver for combination use.

From the foregoing description, it will be recognized by those skilled in the art that a socket drive extension grip offering advantages over the prior art has been provided. Specifically, the socket drive extension grip provides greater flexibility to the use of a socket tool.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A socket drive extension grip for being secured to a socket drive extension, the socket drive extension defining a male head, a female head and a shaft, said socket drive extension grip comprising:

a handle defining a first end, a second end and an opening extending between said first end and said second end, said handle for gripping with a user's hand;

a shaft robe dimensioned to be closely received within and coaxial with said opening of said handle, said shaft tube being configured to receive the shaft of the socket drive extension; and a clamping device for releasably securing the shaft of the socket drive extension within said shaft tube and for preventing said socket drive extension from rotating in said shaft tube.

2. The socket drive extension grip of claim 1 wherein said handle defines a countersunk area proximate said second end thereof for receiving the female head of the socket drive extension.

3. The socket drive extension grip of claim 1 wherein said clamping device includes a set screw receivable by a threaded opening defined by said handle and said shaft tube, said set screw contacting a portion of the shaft of the socket drive extension and wedging the shaft in said shaft tube.

4. The socket drive extension grip of claim 1 wherein said clamping device includes a first set screw and a second set screw, said handle and said shaft tube defining a first threaded opening and a second threaded opening, said first threaded opening and said second threaded opening disposed approximately 180 degrees from one another, said first set screw being received by said first threaded opening, said second set screw being received by said second threaded opening, said first set screw and said second set screw contacting opposing sides of the shaft of the socket extension drive thereby wedging the shaft therebetween.

5. A socket drive extension grip for securing to a socket drive extension, the socket drive extension includes a male head, a female head and a shaft, said socket drive extension grip comprising:

a handle defining a first end, a second end and an opening extending between said first end and said second end, said handle for gripping with a user's hand;

a shaft, tube dimensioned to be closely received within and coaxial with said opening of said handle, said shaft tube configured to receive the shaft of the socket drive extension, said shaft tube defining an extended portion extending above said first end of said handle, said extended portion defining at least two slots extending in an axial manner thereby forming at least two tube sections, said extended portion defining a tapered thread;

a clamping device for releasably securing the shaft of the socket drive extension within said shaft tube and for preventing said socket drive extension from rotating in said shaft tube, said clamping device including said shaft tube extended portion and a clamping nut receivable by said tapered thread, said clamping nut forcing said at least two tube sections inward against the shaft of the socket drive extension as said clamping nut is screwed onto said tapered thread thereby preventing the shaft of the socket drive extension from rotating in said shaft tube.

6. The socket drive extension grip of claim 5 wherein said handle defines a countersunk area proximate said second end thereof for receiving the female head of the socket drive extension.

7. A socket drive extension grip for securing to a socket drive extension, the socket drive extension includes a male head, a female head and a shaft, said socket drive extension grip comprising:

a handle defining a first end, a second end and an opening extending between said first end and said second end, said handle for gripping with a user's hand;

a shaft tube dimensioned to be closely received within and coaxial with said opening of said handle, said shaft tube being configured to receive the shaft of the socket drive extension; and a clamping device for releasably securing the shaft of the socket drive extension within said shaft tube and for preventing said socket drive extension from rotating in said shaft tube, said clamping device including a first set screw received by a first threaded opening defined by said handle and said shaft tube, said first set screw contacting a portion of the shaft of the socket drive extension and wedging the shaft in said shaft tube.

8. The socket drive extension grip of claim 7 wherein said handle defines a countersunk area proximate said second end thereof for receiving the female head of the socket drive extension.

* * * * *